US007464920B2

(12) United States Patent
Romig et al.

(10) Patent No.: US 7,464,920 B2
(45) Date of Patent: Dec. 16, 2008

(54) SMALL BOOKLET BINDING MACHINE

(75) Inventors: Carol Joan Romig, Colorado Springs, CO (US); Elizabeth Sarah Romig, Denton, TX (US); James Clair Romig, Colorado Springs, CO (US)

(73) Assignee: MICR Prime Services, Inc., Colorado Springs, CO (US)

( * ) Notice: Subject to any disclaimer, the term of this patent is extended or adjusted under 35 U.S.C. 154(b) by 567 days.

(21) Appl. No.: 11/127,026

(22) Filed: May 11, 2005

(65) Prior Publication Data

US 2005/0271498 A1 Dec. 8, 2005

Related U.S. Application Data

(60) Provisional application No. 60/570,386, filed on May 12, 2004.

(51) Int. Cl.
*B41F 13/66* (2006.01)

(52) U.S. Cl. ..... 270/5.03; 270/5.02; 270/52.03; 270/52.07; 270/52.09; 270/52.13

(58) Field of Classification Search ..... 270/5.02, 270/5.03, 52.03, 52.07, 52.09, 52.13; 412/9
See application file for complete search history.

(56) References Cited

U.S. PATENT DOCUMENTS 4,465,305 A 8/1984 Bateman et al.
4,566,721 A 1/1986 Friedman et al.
5,207,412 A * 5/1993 Coons et al. ..... 270/1.02
5,449,157 A * 9/1995 Kawano et al. ..... 270/58.11
5,570,875 A * 11/1996 Jung ..... 270/58.09
5,709,376 A * 1/1998 Ushirogata ..... 270/58.11
6,231,225 B1 5/2001 Bedol
6,267,034 B1 * 7/2001 Beckwith ..... 83/305
2004/0262832 A1 * 12/2004 Kaneko ..... 270/58.08

* cited by examiner

*Primary Examiner*—Gene Crawford
*Assistant Examiner*—Leslie A Nicholson, III
(74) *Attorney, Agent, or Firm*—James W. Huffman

(57) ABSTRACT

A small booklet binding machine is presented for use in financial institutions to produce onsite, in an economical and expedient fashion, bound booklets for use as checkbooks, loan coupon books, or other forms of small booklets. A user places paper stock to be processed by the machine into an input tray. The user then places backer cards into the machine. The machine automatically advances the paper stock through a pair of rollers, which substantially slit the paper stock into a plurality of checks which are collated in a collector tray. When the machine has advanced and slit all of the paper stock in the input tray, the collector tray rotates to allow a stapler to secure the plurality of checks to the backer cards. The collector tray then rotates to allow a user to remove the bound checks from the machine. Operationally, the machine produces bound checkbooks, or loan coupon books, without user intervention, other than supplying the machine with backer cards.

16 Claims, 7 Drawing Sheets

SMALL BOOKLET BINDING MACHINE

CROSS REFERENCE TO RELATED APPLICATION

This application claims the benefit of U.S. Provisional Application 60/570,386, filed May 12, 2004.

FIELD OF THE INVENTION

This invention relates in general to the field of small booklet binding, and more specifically to an apparatus and method for binding of booklets used in financial institutions such as checkbooks and loan payment booklets.

BACKGROUND OF THE INVENTION

Many institutions, particularly banking institutions, require Magnetic Ink Character Recognition (MICR) characters on many of their documents. MICR is a technology used to verify the legitimacy or originality of paper documents, such as checks, loan payment coupons, etc. Special ink, which is sensitive to magnetic fields, is used in the printing of certain characters on the original documents. The use of MICR characters enhances security and minimizes losses caused by some types of crime. If a document has been forged—for example, a counterfeit check produced using a color photocopying machine, the magnetic-ink line will either not respond to magnetic fields, or will produce an incorrect code when scanned using a device designed to recover the information in the magnetic characters. Even a legitimate check will be rejected if the MICR reader indicates that the owner of the account has a history of writing bad checks. Retailers commonly use MICR readers to minimize their exposure to check fraud. Corporations and government agencies also use the technology to speed up the sorting of documents.

When an individual (or company) opens a new account at a bank (or other institution), whether a checking account, or a loan (auto, personal, etc.), the institution may provide the individual with a small set (typically 8 to 12) of temporary checks, loan coupons, deposit slips, withdrawal slips, etc., with the MICR characters associated with their new account printed on the bottom. To print these temporary checks, the institution must own software that allows for printing of the MICR characters, and, special toner within a laser printer that will produce the characters with the necessary properties to be read by MICR readers. Such temporary checks are produced using pre-cut (or perforated) stock that is hand fed into a feed tray of a laser printer outfitted with MICR toner. One skilled in the art will appreciate that the labor and supply cost associated with producing a set of temporary checks (or loan coupons), as just described, has heretofore prohibited the institutions from providing more than a small number of checks (or loan coupons) to the customer. Rather, a small set of temporary checks are provided, leaving the customer to await shipment of their permanent checks (or loan coupon booklet). The institution will typically order the permanent stock from a check (or booklet) manufacturer. Such manufacturers utilize high volume printing and binding devices, which are too costly to be used by the institutions, much less by their local branches. Further, with every increasing labor costs, and rising postage rates, institutions have begun investigating alternative on-site production facilities.

However, as is more often the case, financial institutions use off-site print contractors for checks and loan coupons. That is, while they could use MICR document production software and toner, as described above, most do not have it. Thus, what they provide to customers are blank non-personalized counter checks, which most merchants will not accept. Thus, customers leave with almost useless temporary stock, and must wait for the off-site producers to provide them with permanent checks. The delay associated with this wait is a significant problem for the institutions.

The technology required for in-house production includes: personal computers, appropriate MICR software, and non-impact laser printers utilizing MICR toner cartridges. This technology has been available for several years. But, at least two significant barriers remain to be solved before the technology gains broad acceptance. More specifically: 1) cutting stock to size; and 2) binding (or unitizing) the stock into a pad or booklet. Companies that use MICR documents to facilitate financial transactions with their customers most often own laser printers. Typically such printers are of a design that uses individual sheets of paper, simply referred to as "cut sheet", to produce finished documents. The process works well when full sheets of printed material are required. However, MICR documents do not require full sheets. Rather, MICR documents are of a smaller size, in most cases of a size similar to a personal check. Pre-perforated paper stock makes it possible to print multiples of the smaller items on a single sheet, which then may be separated into individual forms to create pages for inclusion in a pad or booklet. But, this has been less than a complete solution, because the manual process is labor intensive, slow, and tedious. And, perforated stock typically leaves rough edges, which are not as desirable as cut stock. Employees are required to separate or, in some cases, cut the paper that has been printed with the variable information into individual pages, stack the pages, jog the stack of pages into alignment, staple or affix the whole package together in combination with some sort of cover, and add a section of tape or through some such method cover the spine of the booklet or pad in a manner that will give it a finished appearance.

Applicant's have been in the business of providing MICR software, and MICR toner to banking institutions for a number of years. Long ago, they recognized the need for local branches to be able to provide a small set of temporary checks (or coupons) to the customer, at the time an account was created. However, they also recognized that a preferred solution would be for the local branch to produce greater quantities of temporary stock, as well as their own permanent stock of checks, or loan coupons, at the time of account creation. But as mentioned above, the current state of the art includes machines that are too costly, and made for too high a volume, to allow institutional branches to procure and utilize them locally.

Therefore, Applicant's have developed an apparatus and method to allow production of bound checks and loan coupons at local branches, in a cost effective and efficient manner. More specifically, what will be described below in the Detailed Description is an invention which allows a local bank to produce their own checkbooks, and loan coupon books (as well as other MICR documents), in sufficient quantity to satisfy its customers, with very little additional labor over the existing method of producing temporary checks, and with minimal investment. Moreover, the small booklet binding machine described below, in combination with a binder card of the present invention automates the cutting and binding tasks required to produce booklets into a simple 2-step operation that is simple, faster, and substantially less expensive than anything currently available.

SUMMARY

The present invention provides an apparatus for producing bound checkbooks in an automated, but cost effective fashion. The apparatus includes an input tray, a slit/pull mechanism, a collector tray, and a stapler. The input tray is provided to hold paper stock. The slit/pull mechanism causes the paper stock to be advanced through the apparatus, and to be substantially slit into checks. In one embodiment the stock is slit entirely. However, another embodiment causes the checks to be substantially slit, while still having connector tabs attached between the checks. The connector tabs allow the checks to drop into the collector tray as one piece of stock, rather than as a plurality. The collector tray receives the substantially slit checks, and has fingers for securing backer cards to the collector tray. The stapler is used to staple the checks to the backer cards. The apparatus performs the functions of advancing the paper stock, slitting the paper stock, and stapling the substantially slit checks to the backer cards, in an automated fashion.

In one aspect, the slit/pull mechanism includes two rollers which rotate in opposite directions to cause paper to be advanced through them. And, in combination with the rollers, slitter/anvil pairs are provided which cause stock to be slit as the paper is advanced. The slitter/anvil pairs have rotatably aligned notches or gaps which stop the slitting operation, thereby creating connector tabs between the slit paper as it advances through the rollers.

In another aspect, the present invention provides a backer card for use in a check binding apparatus to form a checkbook. The backer card includes a backer panel, an insert panel, a staple position, and an adhesive strip. The backer panel provides support and backing to a plurality of checks. The insert panel provides an insert into a vertically aligned check wallet. The staple position provides a location on the backer card where it can be secured to the plurality of checks. The adhesive strip allows the backer card to be adhesively secured to the plurality of checks. Further, the backer card contains a number of scores between the adhesive strip and the staple position to allow the backer card to be folded over a varying number of checks.

In yet another aspect, the present invention provides a small booklet binding machine having an input tray for holding stock to be processed; a feed mechanism for advancing the stock through the machine, and for causing the stock to be slit; a collector, for receiving the slit stock; and a binding mechanism for causing the slit stock to be secured to a binder card.

DETAILED DESCRIPTION

Small Booklet Binding Machine

Figure 1:
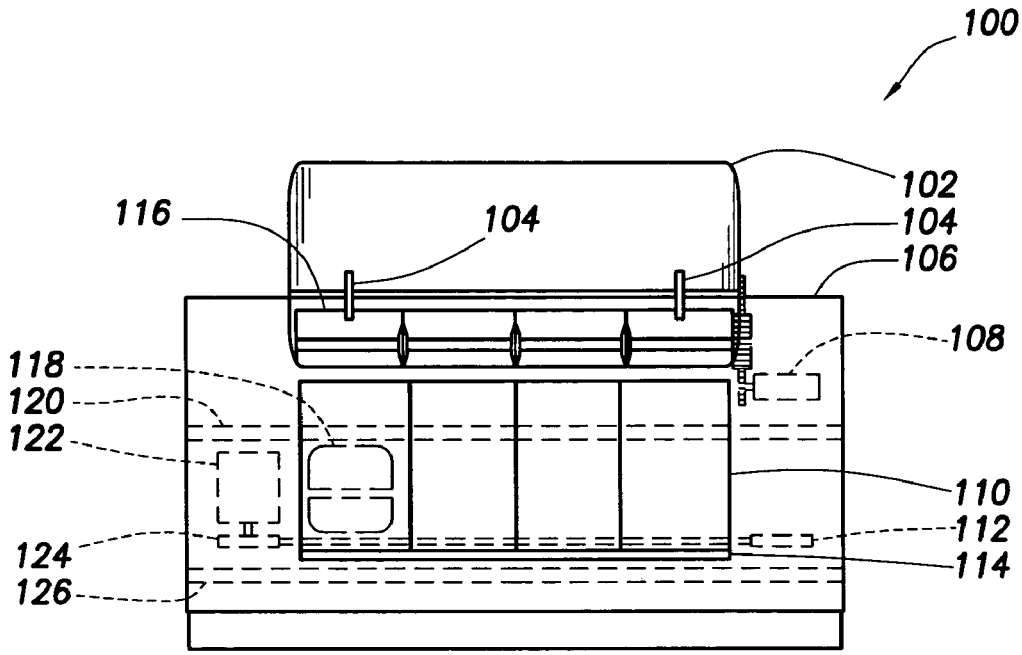
FIG. 1 is a front view of a booklet binding apparatus according to the present invention.

Referring to FIG. 1, a front view is provided of a small booklet binding apparatus 100 according to the present invention. The small booklet binding apparatus 100 processes pre printed paper stock into sets of cut and bound checks, or loan coupon booklets. More specifically, paper stock is printed using a laser printer with a MICR toner cartridge, and a computer having MICR document production software. In one embodiment, four checks (or coupons) can be printed, per page, with the number of pages printed varying according to how many checks or coupons the institution desires to give its customers. The printed paper stock is then inserted into the apparatus 100 which cuts the stock, collects the stock into individual booklets, staples the booklets, and then binds the booklets together. The functions of feeding the stock, cutting the stock, collating the stock, and binding the stock into booklets is performed in an automated fashion, with little or no user intervention between steps required. The result is a set of bound check or coupon booklets, produced on site within minutes, while the customer waits. Thus, rather than a customer receiving a small quantity of temporary checks, s/he can walk out with as many checks as the bank desires to provide.

In one embodiment, the dimensions of apparatus 100 are 18"×18"×13", which is essentially desktop in size. The apparatus 100 is housed within a chassis 106. The apparatus 100 includes a paper tray 102 for holding paper stock of varying sizes which will be fed into and processed by the apparatus 100. The apparatus 100 further includes paper-in feeds 104 which touch the paper stock, a sheet at a time, feeding a sheet into the apparatus 100. Although the paper stock can vary in size, in one embodiment, the paper stock is 6½ inches by 11 inches. This size stock was chosen because checks are typically 6½ inches wide, and 2¾ inches tall. Thus, a sheet of 6½×11 inch stock can be cut into 4 pieces of 6½×2¾ inch stock, equivalent to 4 checks. The apparatus further includes a drive motor and gear train 108. The drive motor and gear train 108 causes the paper stock to advance through the apparatus 100 by rotating a paper slit/pull mechanism 116 according to the present invention, as will be further described below with reference to FIG. 10.

The paper slit/pull mechanism substantially slits (or cuts) the stock, a sheet at a time, into 4 divisible portions, which drop as a single sheet into the collection bin 110. As a sheet of paper is dropped into collection bin 110, it is stopped at pivot point 114. Further, although not shown in FIG. 1, the dropped paper is then offset slightly with a push member. The push member performs two functions. First, it causes the dropped paper (which begins stacking up) to be aligned. And second, it insures that the stacked paper is not directly in line with the next sheet of paper to be dropped. As will be described further below, with respect to the slit/pull mechanism 116, the paper stock is substantially slit, but not across the entire width of the paper. Rather, the paper is slit substantially, but connector tabs are still provided between the individual slit pieces so that the paper stock continues to drop as a single piece, rather than as a plurality of individual pieces. To prevent connector tabs on the stacked paper from interfering with the drop of the next sheet of stock, the stacked paper is offset slightly (~¼") from the dropped paper.

The apparatus further includes a stepper motor 122 for driving a cogged belt and pulley system 112, 124, which causes a staple head 118 to advance across an upper slider bar 120 and a lower slider bar 126. In operation, once all of the stock inserted into paper tray 102 has been fed thru the slit/pull mechanism 116, and has been slit and stacked into the collector tray 110, the collector tray drops down (as will be shown in FIG. 6), to allow the staple head 118 to staple the collected sheets into four booklets.

Figure 2:
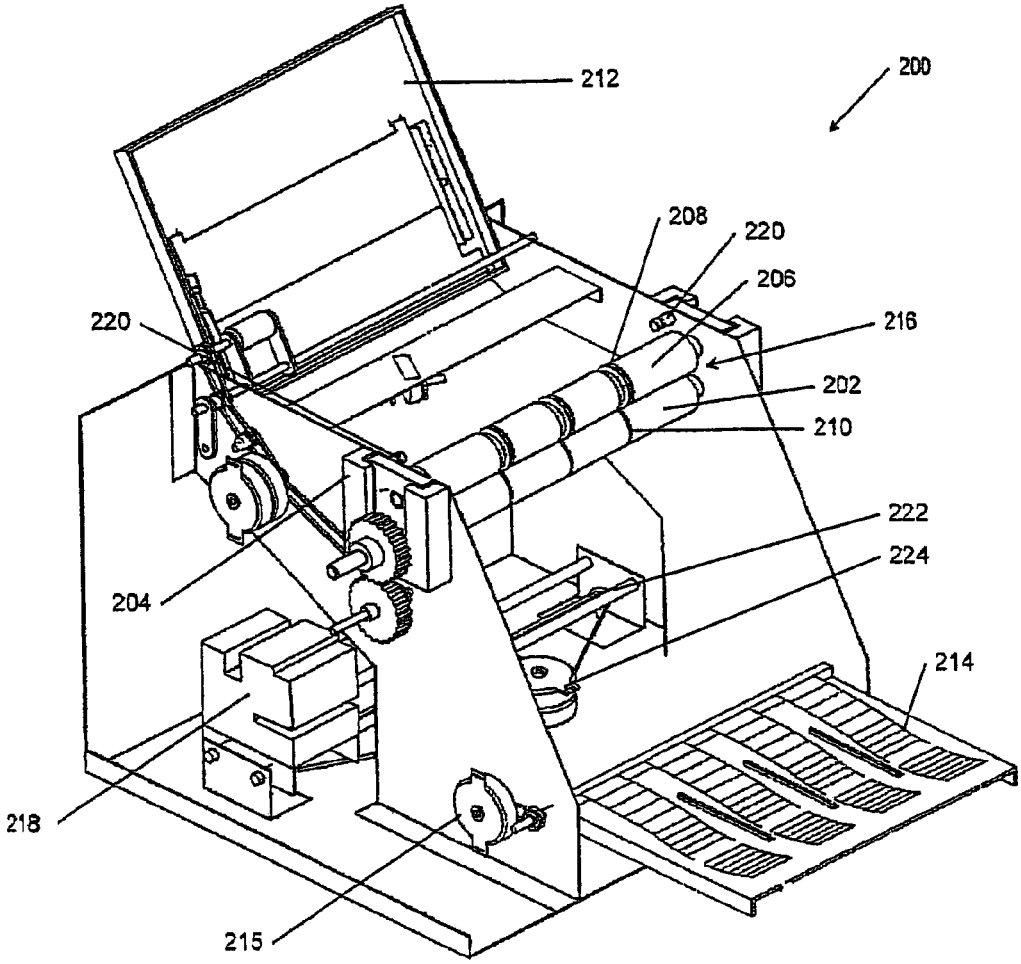
FIG. 2 is a left-top view of a booklet binding apparatus according to the present invention.

Referring now to FIG. 2, an alternative embodiment is provided of an apparatus 200 according to the present invention. Particularly, what is shown is a slit pull mechanism 216 having an upper roller 206 in combination with a lower roller 202. The upper and lower rollers 206, 202 cause paper stock located in the paper tray 212 to advance through the apparatus 200, to be slit or cut by the slit/pull mechanism 216, and to be dropped into the collector tray 214. The material used in the upper and lower rollers 206, 202 may be of any material whose properties create enough friction with the stock in tray 212 to advance the stock through the apparatus 200. However, in one embodiment, the upper roller 206 is made from vulcanized rubber, and the lower roller 202 is made from steel. In an alternative embodiment, the upper and lower rollers 206, 202 have a mix of rubber and steel. For example, the four roller sections of the upper roller 206, from left to right, are steel, rubber, rubber, steel. And, the four roller sections of the lower roller 202, from left to right, are rubber, steel, steel, rubber. Any combination of materials which are designed to pull the paper through the rollers is considered by the inventors. The slit/pull mechanism 216 is secured to the apparatus 200 by pillow blocks 204. The pillow blocks 204 are held in place by thumb screws 220 to allow the slit/pull mechanism 216 to be easily replaced by a user.

As will be further described below with respect to FIG. 10, the slit/pull mechanism 216 comprises a plurality of slitters 208. The slitters 208 are pressed against anvils 210 to cause stock fed through the slit/pull mechanism 216 to be slit or cut. In one embodiment, the slit/pull mechanism has three pairs of slitters 208 against anvils 210 to substantially slit a piece of stock into 4 pieces. However, as mentioned above, the stock is not slit entirely. Rather, a notch is provided within the slitters 208 (further described below with respect to FIG. 10) to allow connector tabs to remain, in various locations, along the slit portions of the stock, thereby insuring that the stock remains intact as it falls into the collector tray 214. What is particularly shown are alignment guides on the bottom side of the collector tray 214 for alignment of backer cards (described below). Coupled to the collector tray 214 is a collector tray drive motor 215. The drive motor 215 is used to rotate the collector tray, as described below with reference to FIGS. 4-7.

FIG. 2 also shows a stapler 218 coupled to rails 222 and a stepper motor 224. As will be further described below, when a collection of paper is to be stapled into a booklet, the stepper motor 224 causes the stapler 220 to advance along the rails 222, into appropriate positioning, and causes the stapler to staple the collection of paper.

Figure 3:
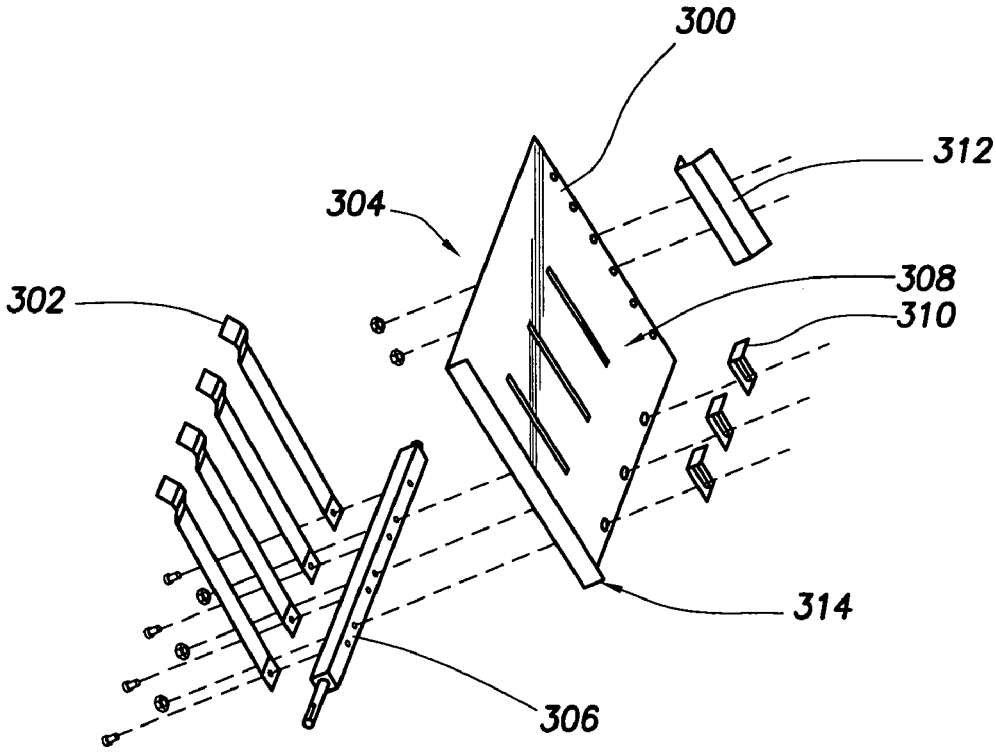
FIG. 3 is an exploded view of a collector tray apparatus according to the present invention.

Referring now to FIG. 3, an exploded view is provided of the collector tray 300 (shown as element 110 in FIG. 1, and element 214 of FIG. 2). Applicants refer to the collector tray 300 as an inverting collector tray 300. This is because, as will be better shown with respect to FIGS. 4-7, both sides of the collector tray 300 are used to form the booklets according to the present invention. More specifically, binder cards (described below with respect to FIGS. 8 and 9) are inserted on the back side 304 of the inverting collector tray 300, and are held in place by spring fingers 302 and stop plate 306. In one embodiment, four binder cards are inserted against the back side 304 of the inverting collector tray 300 prior to starting the booklet cutting/binding process, to secure and form 4 booklets. On the front face 308 of the collector tray 300 are a set of stops 310 against which stock drops and is stopped. Applicants believe that while a number of paper collection trays are known in the prior art, they are not aware of any collector tray which has functional uses on both sides, as is shown in the inverting collector tray 300. Moreover, one skilled in the art will appreciate that the mechanisms shown to allow the binder cards to be held against the back side 304 of the collector tray 300, or to stop the paper which is dropped on the front side 308 of the collector tray are exemplary only. Such mechanisms may be made out of plastic, metal, or may even be formed as part of the collector tray itself as single parts, or a group of parts as shown. What is important is the function that they provide of holding binder cards behind the collector tray 300 while stopping stock dropped on the front side 308 of the collector tray. Also shown in FIG. 3 is a push rod 312, for aligning the dropped stock against wall 314 of tray 300, as described above.

Figure 4:
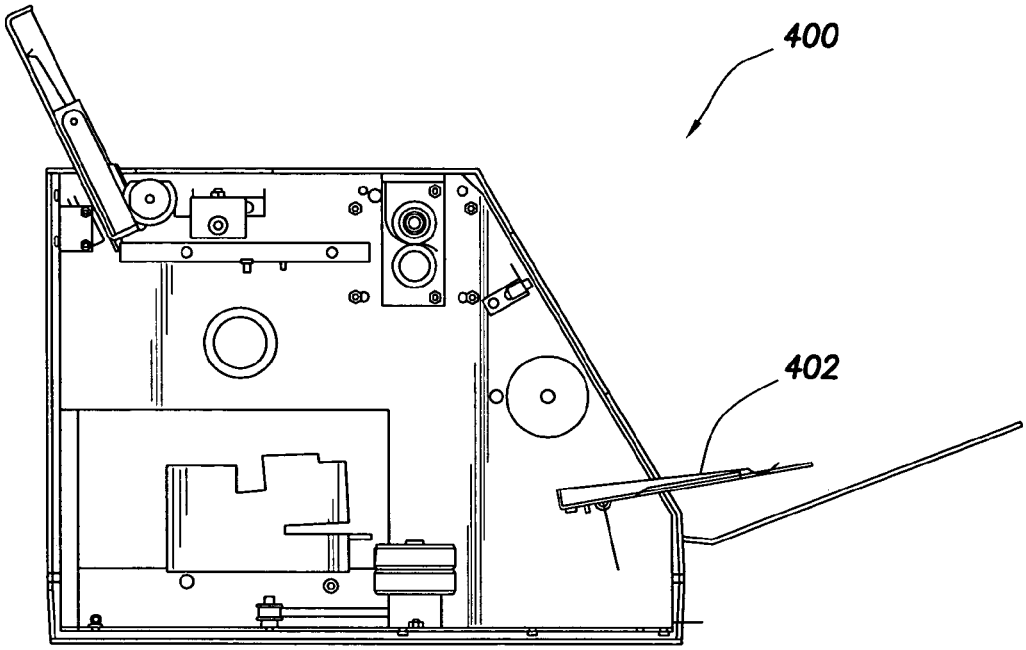
FIG. 4 is a left view of a booklet binding apparatus according to the present invention, particularly illustrating a collector tray in a Load position.

Referring now to FIG. 4, a left side view of the booklet binding apparatus 400 according to the present invention is shown. More specifically, the inverting collection tray is shown, rotated so that the back side 304 is positioned on top, for easy access by a user. That is, when a booklet binding session is desired, the user presses a button on the apparatus 400 to start a session. The apparatus rotates the inverting collector tray 402 into a LOAD position as shown, to allow the user to insert binder cards against the back side of the collector tray. Once the binder cards are inserted, and held by the fingers 402, the user presses a button to indicate they have inserted the cards. The collector tray then rotates into the position shown in FIG. 5 to which attention is now directed.

Figure 5:
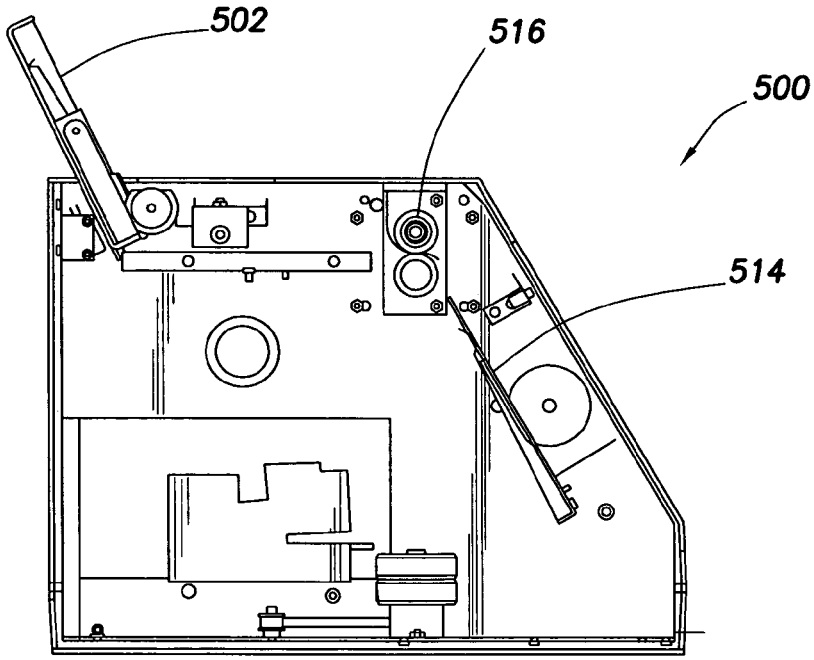
FIG. 5 is a left view of a booklet binding apparatus according to the present invention, particularly illustrating a collector tray in a Slit position.

In FIG. 5, the collector tray 514 has been rotated to receive the slit or cut stock from the slit/pull mechanism 516. Once the collector tray 514 is in the SLIT position, stock that is in the paper tray 502 is fed into the apparatus 500, through the slit/pull mechanism 516, and dropped into the collector tray 514. Once all of the stock in paper tray 502 has been processed by the apparatus 500, the collector tray 514 drops into the STAPLE position shown in FIG. 6, to which attention is now directed.

Figure 6:
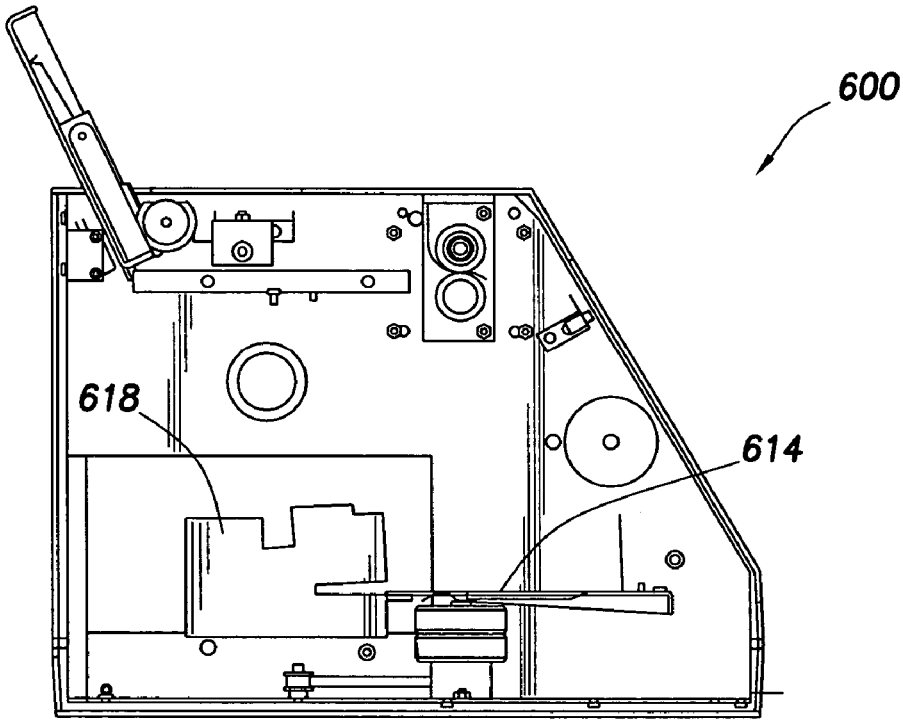
FIG. 6 is a left view of a booklet binding apparatus according to the present invention, particularly illustrating a collector tray in a Staple position.

In FIG. 6, the collector tray is rotated into an essentially horizontal position to allow a staple unit 618 to staple the four booklets together. More specifically, if the user desires to provide a customer with 100 checks, they would print 25 sheets of paper stock with information corresponding to the 100 checks. They would then insert 4 binder cards into the apparatus as shown in FIG. 4. Then, they would take the printed 25 sheets of paper stock and insert them into the paper tray 502. Once the 25 sheets were slit and collected, what would exist on the collector tray 614 would be 25 sheets×4 of stock to be bound. The staple unit 618 is designed to staple through the paper stock, at predefined locations, for each booklet to be bound. In one embodiment, the collector tray 614 is designed, so that the slit paper stock extends slightly beyond the top end of the collector tray (e.g., ⅜"). Further, the binder card extends beyond the top end of the collector tray. Thus, when the collector tray 614 is rotated into the staple position, the staple unit 618 staples the binder cards to their associated paper stock. In one embodiment, the staple unit 618 provides two staples for each booklet, advancing along the slider bars 120 and 126 of FIG. 1. The position of the staple unit 618 is controlled by the stepper motor 122. Once the staple unit has completed its function, the collector tray 614 is rotated into the UNLOAD position shown in FIG. 7, to which attention is now directed.

Figure 7:
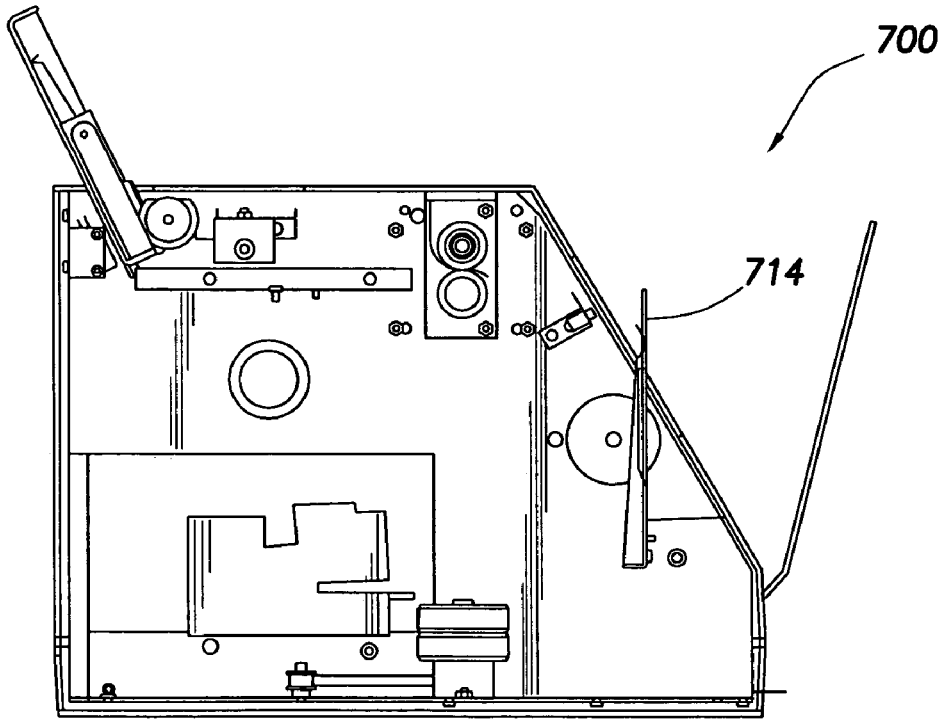
FIG. 7 is a left view of a booklet binding apparatus according to the present invention, particularly illustrating a collector tray in an Unload position.

In FIG. 7, the collector tray 714 is shown in an essentially vertical position. At this point, all of the stock has been slit, collected, and stapled together into four booklets, with the binder cards. The user can now remove the stock from the collector tray 714. In one embodiment, although the binder cards are separate, as discussed above, the stock, although substantially slit, is still held together by connector tabs. The connector tabs have allowed the stock to remain as one piece, for processing. Now, the user can simply bend the stock, causing the connector tabs to break, thereby producing four booklets of checks or coupons.

Backer (Binder) Card

Figure 8:
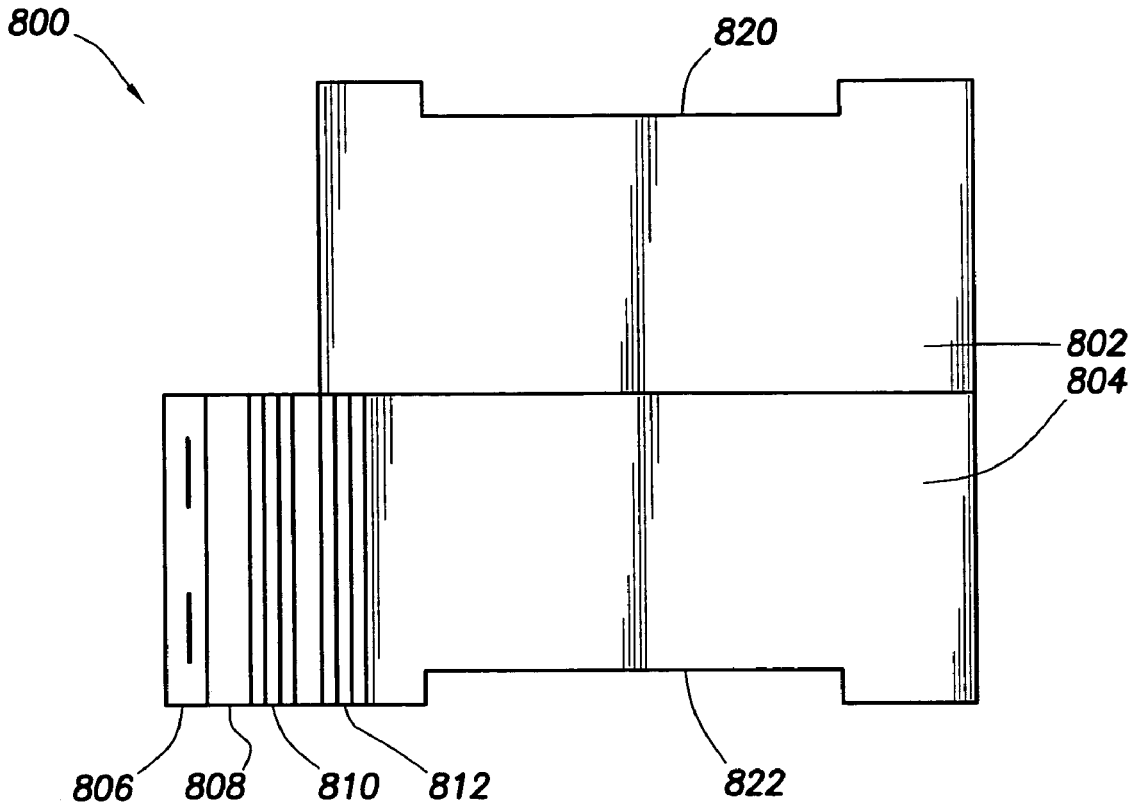
FIG. 8 is a top down view of a binder card according to the present invention.
Figure 9A:
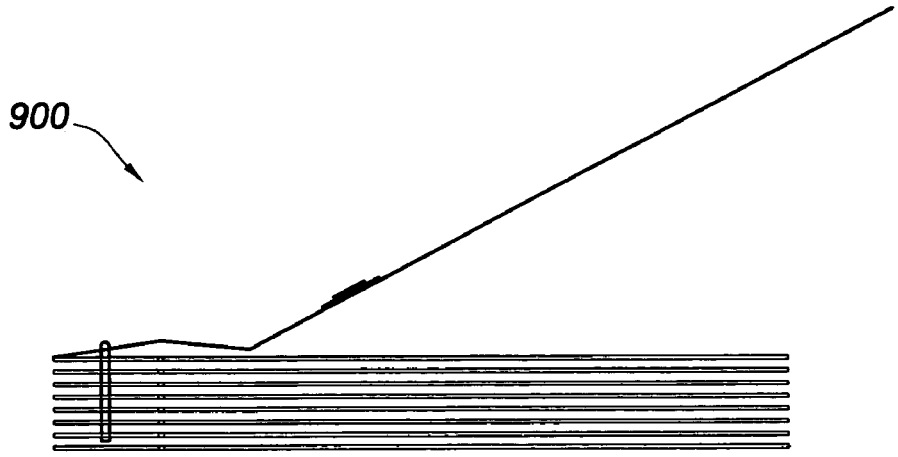
FIG. 9 is side view of a binder card assembly according to the present invention, particularly illustrating a three step method for assembling a booklet using the binder card assembly.
Figure 9C:
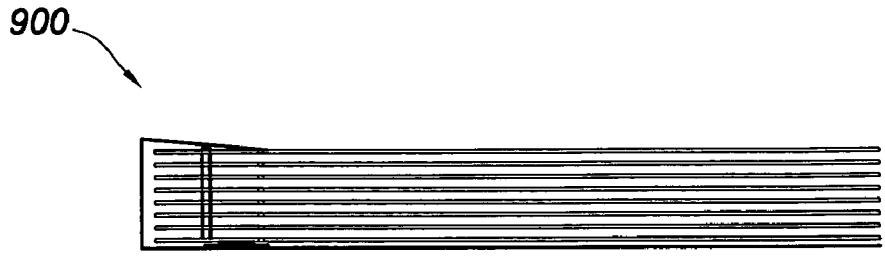
Figure 9D:
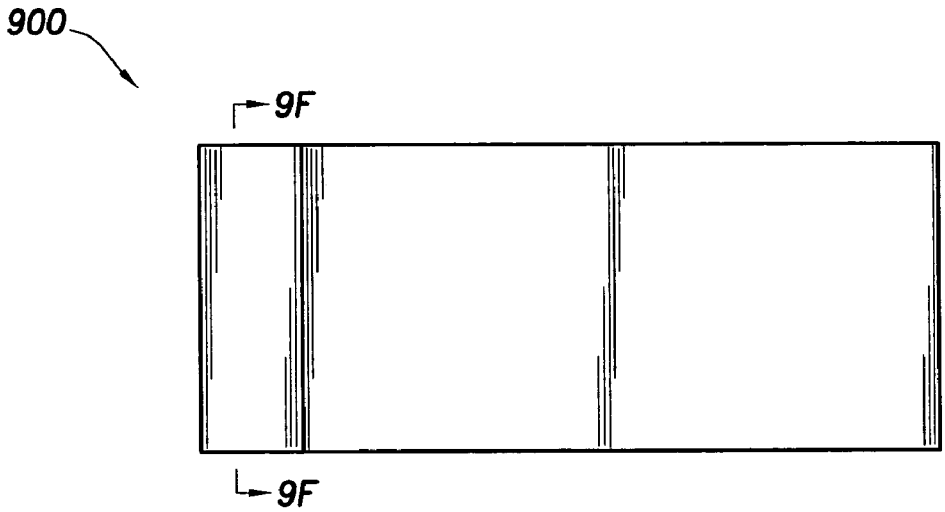
Figure 9E:
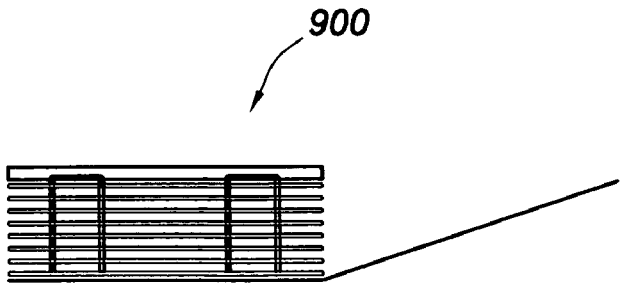
Figure 9F:
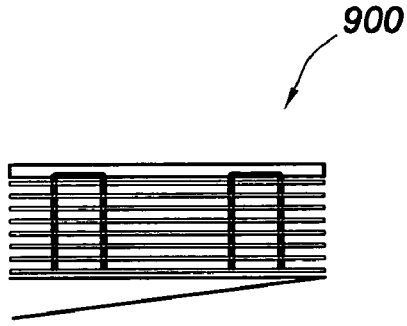

Referring now to FIG. 8, a backer card (or binder card) 800 is shown according to the present invention. In the prior art, backer cards provide stability to a group of checks, or coupons, as well as providing a means for the booklet to be held within a checkbook, or check style wallet. That is, in mass produced checkbooks, a group of checks (25) along with several deposit slips are stapled together across the top, to a backer card. Tape is then placed over the staples. The backer card provides stability to the group of checks. In addition, the backer card may be inserted, vertically, into a check style wallet. Vertically insertable backer cards are ubiquitous in the industry.

The backer card 800 of the present invention has been designed to allow for production of checkbooks (or coupon booklets) as described above, while still allowing such booklets to be inserted into check wallets that are 2 sided (i.e., open at the top and left side) or 3 sided pocket designs. More specifically, the backer card 800 comprises a single piece of card stock, with predefined bends which allow the backer card 800 to perform 3 functions. First, the backer card 800 has an insert panel 802 which may be inserted into vertical oriented check wallets. Second, the backer card 800 has a backer panel 804 which provides a stiff backing to the collection of checks which are stapled to it. In one embodiment, both the backer panel 804 and the insert panel 802 have recessed notches 822 and 820 respectively, which allow the backer cards 800 to be inserted into a form on the back side of the inverting collector tray, for proper alignment. A third function of the backer card 800 is to cover the staples that hold the checks together, and to the backer card 800. This function is accomplished by providing an adhesive strip 812, along with a number of fold lines or scores 808, 810 as will be described below with respect to FIG. 9. The backer card is stapled to the checks at staple position 806. Thus, the backer card 800, within one piece of card stock, performs the functions of providing stability to a group of checks, covering up the staples, and allowing for vertical insertion into a check wallet. An alternative embodiment of the backer card removes the insert panel 802. In this embodiment, the backer card would function to provide stability to the checks, as well as covering up the staples, but would only be insertable into horizontally aligned wallets.

Referring to FIG. 9, a flow 900 is shown to illustrate how the backer (binder) card 800 provides the functions described above with respect to FIG. 8. More specifically, after the user removes the 4 checkbooks from the inverting collector tray, as described above with respect to FIG. 7, and has bent the paper stock to separate the 4 checkbooks (i.e., by breaking the connector tabs), each checkbook must be formed. At step 1, the backer card, which has been stapled to the checks, is rotated so that the backer card is on top, with the staples facing away from the user. The backer card is then folded away from the checks, and away from the user, to wrap around the stapled end of the checks, and back underneath the checks. At this point, the peel portion of the peel and stick adhesive is removed, so that the adhesive comes in contact with the bottom of the group of checks. The user presses down on the group of checks to cause the backer card to adhere to the bottom. At this point, the backer card has performed the two functions of providing stability to the group of checks, and covering up the staples which hold the checks together. Finally, the insert panel is folded underneath the backer panel, as shown in Step 3 of FIG. 9. The insert panel may now be inserted into a vertically aligned check wallet.

What has been described above, with respect to FIGS. 1 thru 9, is an apparatus which allows a financial institution to economically, and expediently produce their own checkbooks or loan coupon books in quantity, rather than providing the customer with a small set of temporary checks. The process for producing the checkbooks utilizes the institutions existing computers, laser printers and software. The existing infrastructure is supplemented with the small booklet binding machine of the present invention, and a supply of backer cards. To produce the booklets, stock is printed on by the laser printer, and moved to the binding machine. Backer cards are inserted into the machine, and quickly, the machine slits the stock, staples the stock to the backer cards, and presents the booklets to the user. The user folds the backer cards around the booklets and presents permanent checks (or loan coupons) to the customer.

Slit/Pull Mechanism

Figure 10A:
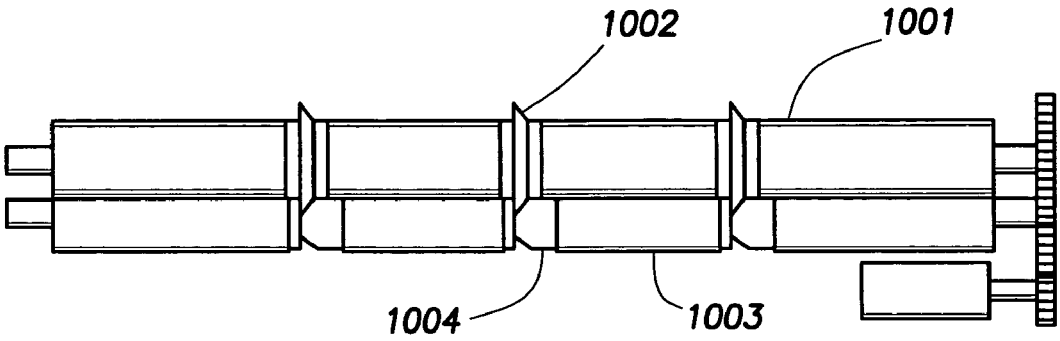
FIGS. 10A, 10B and 10C, respectively, are front, top and end views of a slit/pull mechanism of the present invention.
Figure 10B:
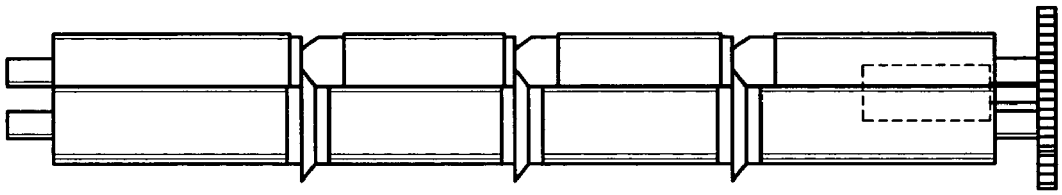
Figure 10C:
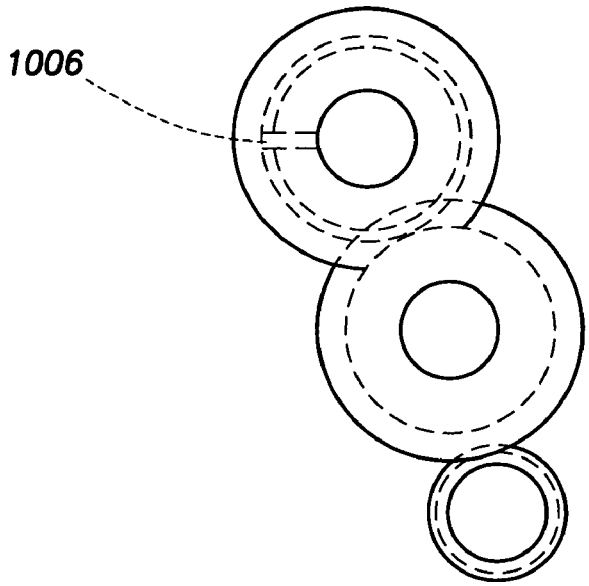

Attention is now directed to FIG. 10, where a particular embodiment of the slit/pull mechanism of the present invention is shown. More specifically, a top roller 1001 is shown against a bottom roller 1003. The top roller 1001 contains a plurality of rotary knives (or slitters) 1002. The bottom roller 1003 contains an equivalent plurality of anvils 1004 which are shaped to mate against the rotary knives 1002. As paper passes between the upper roller 1001 and the bottom roller 1003, the rotary knives 1002 press against the anvils 1004 and slit the paper. However, as mentioned above, one embodiment of the invention does not slit the paper from end to end. If this occurred, the paper stock would not remain as one piece. Applicant's initially tried to slit the stock from end to end, but found that aligning the individual slit pieces created additional problems in collating. Therefore, Applicant's designed the rotary knives to have a gap 1006, which when it rotates against the anvil, causes the slit operation of the knives to cease, leaving a connector tab in the stock.

As explained above, connector tabs in the stock allows the sheet, in one embodiment 6½"×11" to be cut into 4 pieces of 6½"×2¾", while still functioning as a single sheet, until broken apart. Further, the connector tabs typically are located in different locations on each sheet of stock, so that the booklets can be easily separated.

Although the present invention and its objects, features, and advantages have been described in detail, other embodiments are encompassed by the invention. For example, the slit/pull mechanism described above utilizes roller assemblies in contact with each other, in combination with the slitters and anvils, to produce the slit sheets. However, it should be appreciated by one skilled in the art that alternative means may be used to guide the paper across the slitters.

Further, the assemblies used to slit the stock need not be in combination with the assemblies used to advance the paper. It is possible that two distinct mechanisms could be used without departing from the scope of this invention. Further, the slit/pull mechanism of the present invention illustrates fixed slitters/anvils, relative to the rollers. It is possible to design the slitter/anvil assemblies to allow them to be adjusted, as needed, to allow for wider or narrower stock. More specifically, Applicant's envision slitter/anvil assemblies which are each movable along the shaft of the rotors to provide for wider or narrower cuts. Moreover, it is also envisioned that many shapes of connector tabs might be designed, to allow for greater or lesser connectivity between the slit pieces of stock. Additionally, more than one pair of notches or gaps may be provided for in each slitter/anvil combination. Moreover, the above invention has been described to produce checks having dimensions of 6½"×2¾" by using stock which is 6½"×11". One skilled in the art will appreciate that other size stock can be used without departing from the scope of the present invention. For example, perforated stock was described above as being suboptimal because of the rough edges it leaves. However, it is possible to have stock which is letter sized (i.e., 8½"×11") with a perforation along the length, 1½" from the left side. This would allow the stock to be presented to the laser printer as regular letter sized paper, and then separated at the perforation before being presented to the apparatus of the present invention. Alternatively, the apparatus of the present invention could accommodate such paper, and contain means to break the stock at the perforation before it is stapled into booklets. Further, the above invention has been described with particular reference to banking institutions which must produce checkbooks and loan coupons. However, one skilled in the art of booklet binding will appreciate that the apparatus described above may be used wherever the functions of cutting paper to fixed sizes, collating the paper, and binding the paper into booklets is required. It should further be appreciated that while a stapler has been shown to secure the paper into booklets, other means of securing paper together may be used without departing from the scope of the invention. For example, applicant's envision the use of adhesives, as well as staples to secure the paper to the binder cards. Any binding mechanism utilized which secures a plurality of papers together, and to a binder card are within the scope of the present invention.

Finally, those skilled in the art should appreciate that they can readily use the disclosed conception and specific embodiments as a basis for designing or modifying other structures for carrying out the same purposes of the present invention without departing from the spirit and scope of the invention as defined by the appended claims.

We claim:

1. An apparatus for producing a plurality of bound checkbooks, the apparatus comprising:

an input tray for holding paper stock;

a slit/pull mechanism, for causing said paper stock to be advanced through said apparatus, and to be substantially slit into a plurality of checks;

a collector tray, for receiving said substantially slit plurality of checks, said collector tray having fingers for securing at least one backer card to said collector tray, said collector tray comprising a front side for collecting said substantially slit plurality of checks, and a back side for securing said at least one backer card, said fingers being located on said back side of said collector tray; and a stapler, for stapling said substantially slit plurality of checks to said at least one backer card;

wherein the apparatus performs the functions of advancing said paper stock, slitting said paper stock, and stapling said substantially slit plurality of checks to said at least one backer card, in an automated fashion.

2. The apparatus of claim 1 wherein the apparatus may be placed on an average sized desktop.

3. The apparatus of claim 1 wherein said slit/pull mechanism comprises:

an upper roller; and a lower roller; said upper and lower rollers rotating contrary to each other to allow said stock to advance between them.

4. The apparatus of claim 3 wherein said slit/pull mechanism further comprises:

a plurality of knife/anvil pairs, said knife/anvil pairs causing said paper stock to be substantially slit as said paper stock is advanced between said rollers.

5. The apparatus of claim 4 wherein said plurality of knife/anvil pairs have a gap which allows connector tabs to be maintained between the substantially slit plurality of checks.

6. The apparatus of claim 1 wherein said stapler comprises:

a stapler, for stapling a plurality of checks to said at least one backer card;

a motor, for moving said stapler across said plurality of checks and said at least one backer card; and a shaft, for causing said stapler to move parallel to the ends of the plurality of checks which are to be stapled.

7. An apparatus for producing a plurality of bound checkbooks, the apparatus comprising:

an input tray for holding paper stock;

a slit/pull mechanism, for causing said paper stock to be advanced through said apparatus, and to be substantially slit into a plurality of checks;

a collector tray, for receiving said substantially slit plurality of checks, said collector tray having fingers for securing at least one backer card to said collector tray;

a stapler, for stapling said substantially slit plurality of checks to said at least one backer card; and a motor, coupled to said collector tray, for causing said collector tray to be rotated into a plurality of differently oriented positions, the plurality of differently oriented positions including a LOAD position for loading said at least one backer cards to said collector tray, a SLIT position for receiving said substantially slit plurality of checks from said slit/pull mechanism, and an UNLOAD position for presenting said stapled plurality of checks to a user, wherein the apparatus performs the functions of advancing said paper stock, slitting said paper stock, and stapling said substantially slit plurality of checks to said at least one backer card, in an automated fashion.

8. The apparatus of claim 7 wherein said plurality of differently oriented positions further comprise:

a STAPLE position, for stapling said substantially slit plurality of checks.

9. A small booklet binding machine comprising:

an input tray for holding stock to be processed;

a feed mechanism for advancing said stock through the machine, and for causing said stock to be slit;

a collector, for receiving said slit stock; and a binding mechanism for causing said slit stock to be secured to a binder card, said collector comprising a front side for receiving said slit stock, and a back side for holding said binder card, said binder card being held to said back side by a finger.

10. The small booklet binding machine as recited in claim 9 wherein the functions of slitting, receiving and binding are performed in an automated fashion.

11. The small booklet binding machine as recited in claim 9 wherein said input tray holds at least 10 sheets of stock.

12. The small booklet binding machine as recited in claim 9 wherein said feed mechanism comprises:

a pair of rollers rotating opposite each other for causing said stock to advance between said pair of rollers; and a slitter/anvil pair, in cooperation with said pair of rollers, for slitting said stock as it advances between said pair of rollers.

13. The small booklet binding machine as recited in claim 12 wherein said slitter/anvil pair further comprises a gap, for causing connector tabs to remain between slits in said stock.

14. The small booklet binding machine as recited in claim 9 wherein said slit stock and said binder card extends beyond a top of said collector.

15. The small booklet binding machine as recited in claim 9 wherein said binding mechanism comprises a stapler.

16. The small booklet binging machine as recited in claim 9 further comprising:

a push rod for moving across a front side of said collector causing said slit stock to be collated.

* * * * *